United States Patent [19]

Park

[11] Patent Number: 4,648,612

[45] Date of Patent: Mar. 10, 1987

[54] GOLF CART

[76] Inventor: Young G. Park, #KA-305, Dong-A, Apt. #902 Daechi-dong, Kangnam-ku, Seoul, Rep. of Korea, 135-00

[21] Appl. No.: 808,033

[22] Filed: Dec. 12, 1985

[30] Foreign Application Priority Data

Jul. 10, 1985 [KR] Rep. of Korea ..... 85-8634
Jul. 23, 1985 [KR] Rep. of Korea ..... 85-9288

[51] Int. Cl.[4] ..... B62B 1/20

[52] U.S. Cl. ..... 280/47.26; 248/96; 280/DIG. 6

[58] Field of Search ..... 248/96; 280/47.24, 47.26, 280/DIG. 6, 645, 646

[56] References Cited

U.S. PATENT DOCUMENTS 2,575,930 11/1951 Schwartz ..... 280/47.26
2,663,528 12/1953 Hadley ..... 248/96
3,726,537 4/1973 McLoughlin ..... 280/47.26
4,153,264 5/1979 Pfister ..... 280/47.26 X
4,226,389 10/1980 Neth ..... 248/96

FOREIGN PATENT DOCUMENTS 483754 4/1938 United Kingdom ..... 280/DIG. 6

*Primary Examiner*—John J. Love
*Assistant Examiner*—Michael Mar
*Attorney, Agent, or Firm*—Walter F. Wessendorf, Jr.

[57] ABSTRACT

A golf cart having a golf bag for carrying golf clubs. A backbone plate, two L-shaped reinforcing angles and saddle arms are assembled and disposed on the inside of the golf bag. Washer plates are disposed on the outside surface of the golf bag along with an L-shaped protector to protect the lower outside of the golf bag. An arch type wheel assembly is mounted on the middle outside portion of the golf bag and a pulling handle is mounted on the upper outside portion of the golf bag. Detachable assembly and mounting of the foregoing elements is achieved by bolts inserted through aligned holes in such elements and to which are affixed nuts.

7 Claims, 19 Drawing Figures

FIG. 3
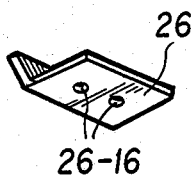
FIG. 4
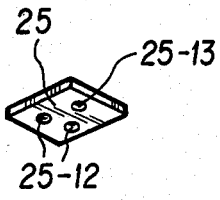
FIG. 5
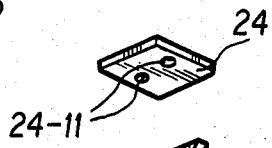
FIG. 6
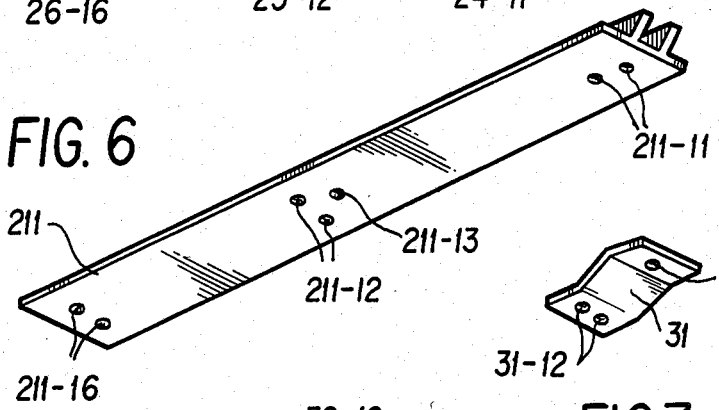
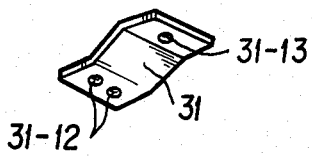
FIG. 7
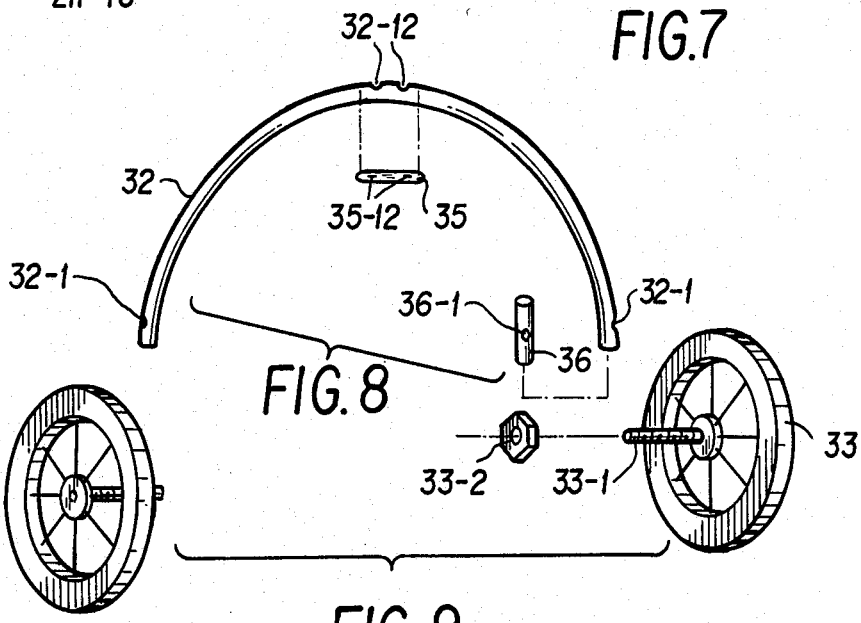
FIG. 8
FIG. 9

FIG. 16
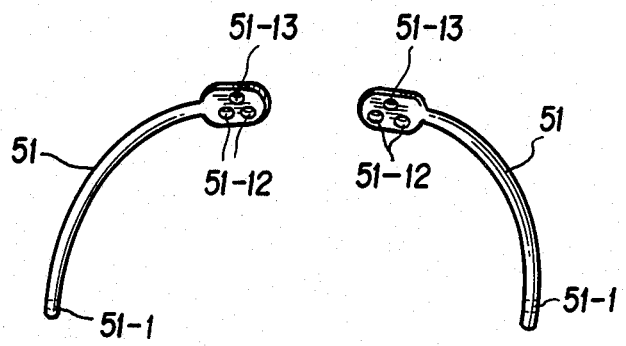
FIG. 15
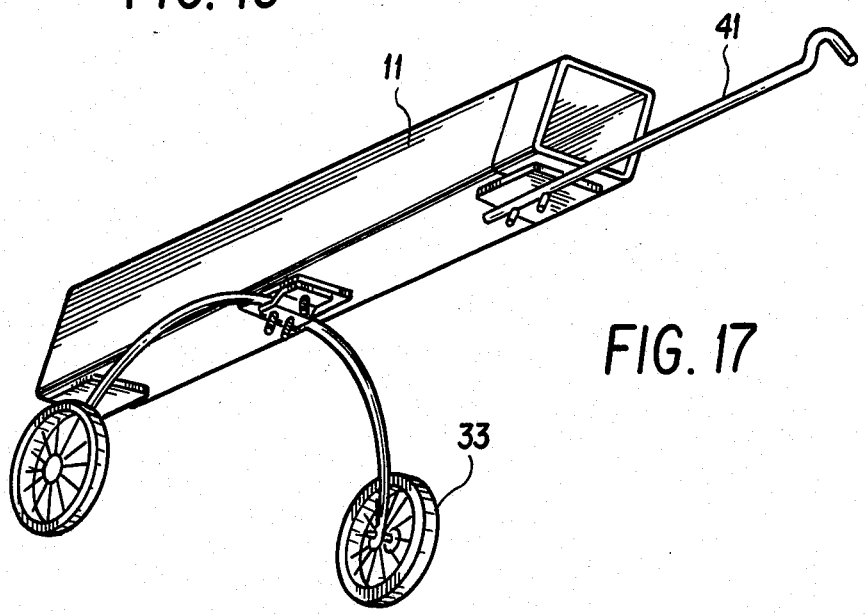
FIG. 17

GOLF CART

BACKGROUND OF THE INVENTION

This invention relates to a golf cart having a golf bag for carrying golf clubs on a golf course. The golf cart comprising its golf bag, pulling handle and two-wheel axle assembly are detachably assembled.

Conventionally, a golf cart and a golf bag are separate items, heavier in weight compared to the present invention, high because of their sophisticated structure, while others of them are inconvenient because of their poor structure.

SUMMARY OF THE INVENTION

Accordingly, the object of this invention is to provide a golf cart in which are detachably assembled a conventional golf bag, pulling handle and two-wheel axle assembly. The pulling handle and axle assembly are made of light metal tubing which can be reinforced at critical points by tubular or solid round inserts to impart strength and structural rigidity without appreciable increase in weight. The wheel axle is arch-shaped or of other suitable shape with partial straight lines.

Three upper, middle and lower saddle arms are interposed between the inside of the golf bag and a backbone plate to hold the golf clubs in the golf bag. The backbone plate can have two L-shaped reinforcing angles defining a U-shaped channel, or the backbone plate itself can be a T-channel type plate or T box-channel type plate.

Washer plates and an L-shaped protector plate are disposed on the outside of the golf bag.

The golf bag, saddle arms, backbone plate, washer plates and protector plate, axle assembly and pulling handle have bolt holes that can be appropriately aligned to provide detachable assembly by bolts inserted through such bolt holes and engaged with nuts such as wing nuts.

All elements of the golf cart are made of light metal.

BRIEF DESCRIPTION OF THE DRAWINGS

FIG. 3 is a perspective view of an L-shaped angle protector;

FIG. 4 is a perspective view of a middle washer plate;

FIG. 5 is a perspective view of an upper washer plate;

FIG. 6 is a perspective view of a T-channel type plate;

FIG. 7 is a perspective view of an S-shaped bridge plate;

FIG. 8 is a perspective view of an arch type wheel axle preparatory to the insertion of tubular inserts;

FIG. 9 is a perspective view of wheels and wheel shaft preparatory to assembly;

FIG. 15 is a perspective view of one of the wheel axles;

FIG. 16 is a perspective view of the other one of the wheel axles;

FIG. 17 is a perspective view of the golf cart shown fully assembled;

DESCRIPTION OF THE PREFERRED EMBODIMENTS

Figure 1:
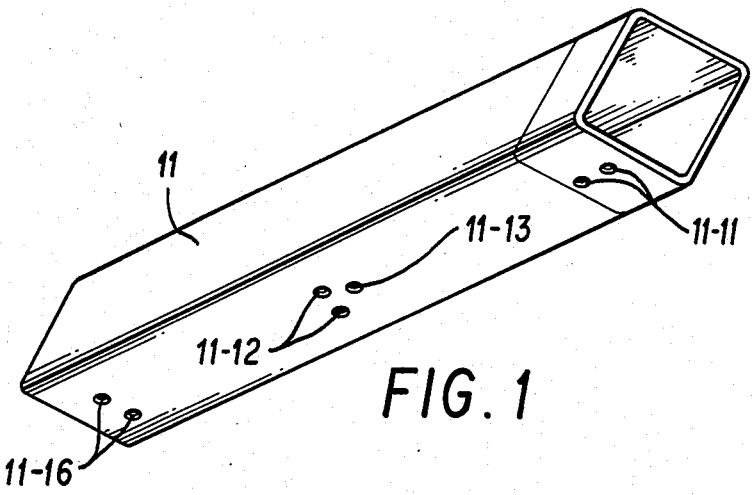
FIG. 1 is a perspective view of the golf bag.

FIG. 1 of the drawings shows the golf bag (11).

Figure 2:
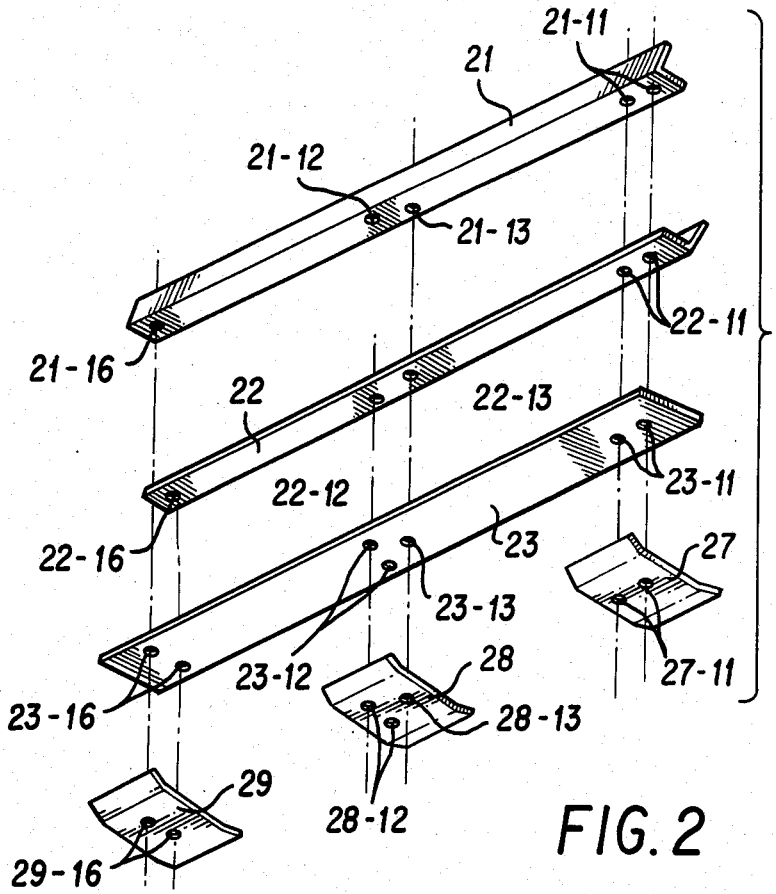
FIG. 2 is a perspective view of the L-shaped angles, backbone plate, and upper, middle and lower saddle arms, preparatory to their assembly.

With reference to FIG. 2, the backbone plate (23) is attached to the inside of the golf bag (11) by aligning its bolt holes (23-11), (23-12), (23-13) and (23-16) with respective golf bag holes (11-11), (11-12), (11-13) and (11-16) via bolts of sufficient length (not shown) disposed through such aligned holes and secured by nuts (not shown) which can be wing nuts.

Two L-shaped reinforcing angles (21 and 22) are also similarly attached to backbone plate (23) via such bolts and nuts after alignment of their respective holes (21-11 and 22-11), (21-12 and 22-12), (21-13 and 22-13) and (21-16 and 22-16) with respective holes (23-11), (23-12), (23-13) and (23-16) of backbone plate (23).

Interposed between the inside bottom surface of golf bag (11) and backbone plate (23) are upper, middle and lower saddle arms (27, 28 and 29) that are similarly attached via such bolts and nuts after alignment of their respective holes (27-11), (28-12), (28-13) and (29-16) with holes (11-11), (11-12), (11-13) and (11-16).

Washer plates (24 and 25) are similarly attached to the outside bottom surface of golf bag (11) via such bolts and nuts after alignment of their respective holes (24-11), (25-12) and (25-13) with respective holes (11-11), (11-12) and (11-13).

Figure 12:
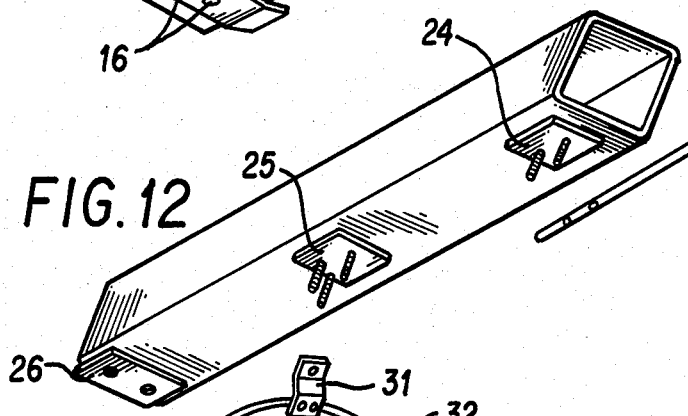
FIG. 12 is a perspective view of the golf bag shown assembled with the upper and middle washer plates and the L-shaped angle protector.
Figure 13:
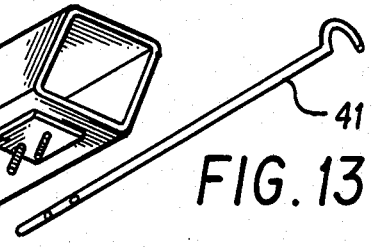
FIG. 13 is a perspective view of the pulling handle.
Figure 14:
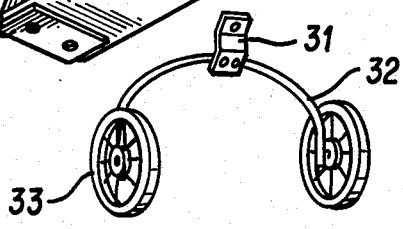
FIG. 14 is a perspective view of the wheel assembly.

Shown in FIG. 12 are two horn-like bolts on the upper part of bag (11), disposed through the holes in the washer plate (24), and which detachably mount pulling handle (41) shown in FIG. 13. Further shown in FIG. 12 are three horn-like bolts on the middle part of bag (11), disposed through the holes in the washer plate (25), and which detachably mount the arch type wheel axle of the wheel assembly shown in FIG. 14 via S-shaped bridge plate (31) shown in FIG. 7 and with such three bolts being appropriately disposed through holes (31-12 and 31-13) in bridge plate (31).

L-shaped angle protector (26) is disposed on the outside lower bottom surface of golf bag (11) and is similarly attached via bolts and nuts after alignment of respective hole (21-16) of angle (21), hole (22-16) of angle (22), holes (23-16) of backbone plate (23), holes (29-16) of lower saddle arm (29), holes (11-16) of bag (11) and holes (26-16) of angle protector (26).

Figure 10:
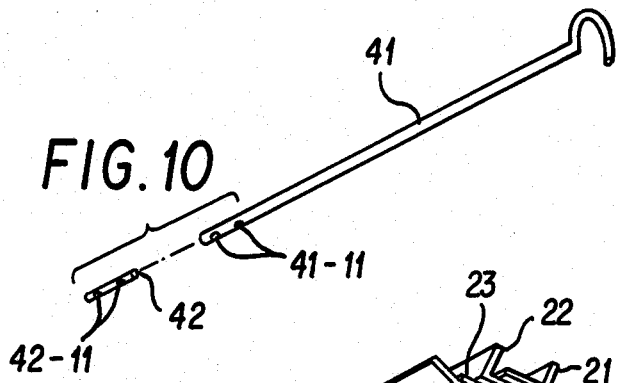
FIG. 10 is a perspective view of the pulling handle preparatory to the insertion of its tubular insert.
Figure 11:
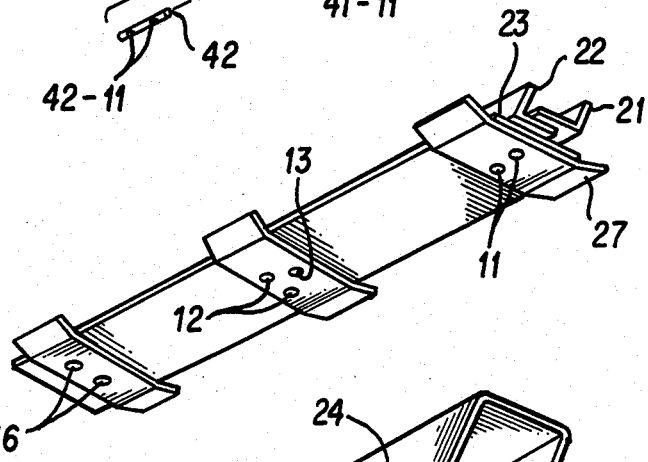
FIG. 11 is a perspective view in assembly of the L-shaped angles, backbone plate and upper, middle and lower saddle arms.

As shown in FIG. 10, the light metal tubing of pulling handle (41) can be reinforced at its critical point by insertion of tubular insert (42), or a solid round insert, with holes (42-11) aligned with holes (41-11). The wheel axle (32) and bridge plate (31) can be welded together in the first instance. Similarly, to reinforce wheel axle (32) and to impart strength and structural rigidity thereto, tubular or solid round inserts are utilized.

Bolt holes (32-1) at the ends of wheel axle (32) are horizontally oriented for receiving threaded wheel shafts (33-1) with detachable securement provided by nut (33-2) engaged with threaded wheel shafts (33-1). To reinforce wheel axle (32) and to impart thereby strength and structural rigidity thereto, inserts (35 and 36), of the tubular type shown, or of the solid type, are appropriately inserted in wheel axle (32) along with the alignment of respective holes (32-1 and 36-1) and holes (32-12 and 35-12).

Figure 19:
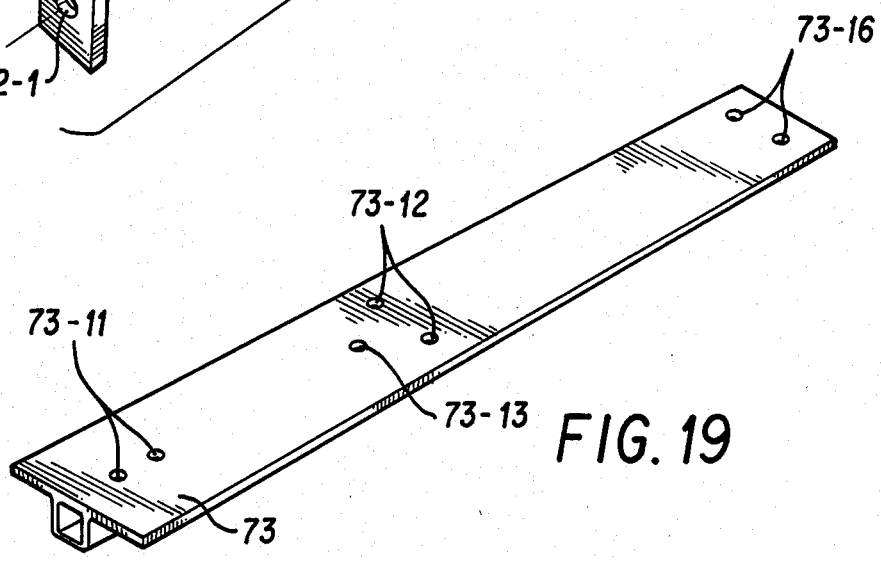
FIG. 19 is a perspective view of the T box-channel type plate.

In another embodiment, the L-shaped angles (21 and 22) can be substituted by a U-shaped channel (not shown), and the backbone plate (23) and reinforcing angles (21 and 22) can be replaced by the T-channel type plate (211), shown in FIG. 6, or by the T box-channel type plate (73), shown in FIG. 19.

In another embodiment, the single wheel axle (32), shown in FIG. 8, can be replaced by the two half axles (51), shown in FIG. 15, joined together by aligning their bolt holes (51-12 and 51-13), to facilitate disassembly to carry the golf cart in an automobile or when the golf cart is not being used.

Figure 18:
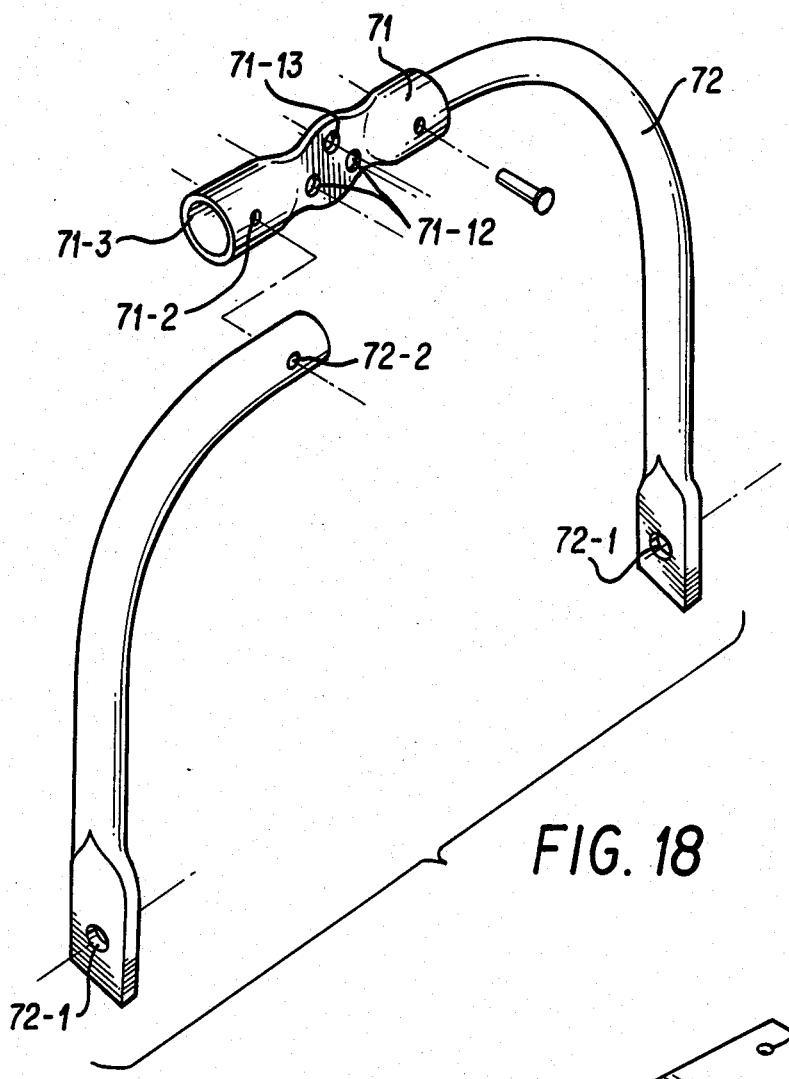
FIG. 18 is a perspective view of a wheel axle bracket and wheel axles preparatory to their assembly.

In another embodiment as shown in FIG. 18, a wheel axle bracket (71) is detachably attached via such bolts and nuts after alignment of holes (71-12) of bracket (71) with holes (25-12) of washer plate (25), and alignment of hole (71-13) of bracket (71) with hole (25-13) of washer plate (25). The wheel axles (72) are appropriately inserted in the complemental holes (71-3) of bracket (71) with securement provided by inserting split pins in the aligned holes (71-2 and 72-2).

In the same manner, the pulling handle (41) can be attached to bag (11).

I claim:

1. A golf cart for carrying golf clubs, said golf cart comprising upper, middle and lower saddle arms, a golf bag having an inside surface and an outside surface, a backbone plate, two L-shaped reinforcing angles, two washer plates, a pulling handle, an arch type wheel assembly and securing means; said upper, middle and lower saddle arms being interposed between said inside surface of said golf bag and said backbone plate to hold the golf clubs in said golf bag, said reinforcing angles being disposed on said backbone plate and defining a U-shaped channel, said washer plates being disposed on said outside surface of said golf bag, said pulling handle being disposed on the exterior of said golf bag and on one of said washer plates, said wheel assembly being disposed on the exterior of said golf bag and on the other of said washer plates, and said securing means securing together in detachable assembled relationship said saddle arms, backbone plate, reinforcing angles, washer plates, pulling handle and wheel assembly.

2. A golf cart in accordance with claim 1, wherein said wheel assembly has a single wheel axle mounting two wheels.

3. A golf cart in accordance with claim 1, wherein said saddle arms, golf bag, backbone plate, reinforcing angles, washer plates, pulling handle and wheel assembly have aligned holes and wherein said securing means comprise bolts and nuts with said bolts disposed through said aligned holes and with said nuts engaged with said bolts.

4. A golf cart in accordance with claim 1, wherein said golf cart is further provided with an L-shaped angle protector, wherein said golf bag has an outside lower bottom surface and wherein said L-shaped angle protector is disposed on said outside lower bottom surface of said golf bag to protect same.

5. A golf cart in accordance with claim 1, wherein said pulling handle is of light metal tubing material and wherein said pulling handle has a tubular insert providing strength and imparting structural rigidity.

6. A golf cart in accordance with claim 2, wherein said single wheel axle is of light metal tubing material and wherein said wheel axle has tubular inserts providing strength and imparting structural rigidity.

7. A golf cart in accordance with claim 2, wherein is further provided a bridge plate, wherein said bridge plate is disposed on the other one of said washer plates and wherein said bridge plate carries said wheel axle in detachable mounting relationship with respect to said golf bag.

* * * * *